US008978271B2

(12) United States Patent
Park et al.

(10) Patent No.: US 8,978,271 B2
(45) Date of Patent: Mar. 17, 2015

(54) SHOES HAVING AN AIR CIRCULATION FUNCTION

(76) Inventors: Soo Hyun Park, Busan (KR); Dong Geon Kim, Busan (KR); Soo Kyung Lee, Ulsan (KR); Soo Hwan Park, Busan (KR); Kyo Joon Lee, Siheung-si (KR)

( * ) Notice: Subject to any disclaimer, the term of this patent is extended or adjusted under 35 U.S.C. 154(b) by 223 days.

(21) Appl. No.: 13/703,887
(22) PCT Filed: Jul. 16, 2010
(86) PCT No.: PCT/KR2010/004656

§ 371 (c)(1),
(2), (4) Date: Dec. 12, 2012
(87) PCT Pub. No.: WO2012/008636

PCT Pub. Date: Jan. 19, 2012
(65) Prior Publication Data

US 2013/0086823 A1 Apr. 11, 2013
(30) Foreign Application Priority Data

Jul. 12, 2010 (KR) ..... 10-2010-0066681
(51) Int. Cl.
*A43B 7/06* (2006.01)
*A43B 7/08* (2006.01)
*A43B 13/20* (2006.01)
(52) U.S. Cl.
CPC . *A43B 7/06* (2013.01); *A43B 7/082* (2013.01); *A43B 13/203* (2013.01); *A43B 7/087* (2013.01)
USPC ..... 36/3 R; 36/3 B
(58) Field of Classification Search
CPC ..... A43B 7/00; A43B 7/06; A43B 7/08; A43B 7/081; A43B 7/082; A43B 7/084; A43B 7/087; A43B 7/088
USPC ..... 36/3 R, 3 B
See application file for complete search history.

(56) References Cited

U.S. PATENT DOCUMENTS 5,619,809 A * 4/1997 Sessa ..... 36/3 R
5,992,052 A * 11/1999 Moretti ..... 36/3 B (Continued)

FOREIGN PATENT DOCUMENTS

CN 26220494 Y 6/2004
JP 3044249 10/1997

(Continued)

OTHER PUBLICATIONS

International Search Report for PCT/KR2010/004656 Mailed on Aug. 23, 2011.

*Primary Examiner* — Marie Bays
(74) *Attorney, Agent, or Firm* — Andrus Intellectual Property Law, LLP

(57) ABSTRACT

The present invention relates to a shoe having an air circulation function. The shoe has a receiving groove in a central portion of a top surface thereof. The shoe includes a sole having an air chamber, a vent passage, and a passage through which air is discharged toward the receiving groove of the sole, an inner cushion inserted into the receiving groove of the sole to provide a cushioning force for restoring the cushion during walking, an inclined adhesion protrusion disposed along an outer circumference of the receiving groove of the sole, the inclined adhesion protrusion being gradually inclined downward from the outside to the inside, a porous valve plate stacked on a top surface of the inner cushion, the porous valve plate having a lower end circumference surface contacting a top surface of the inclined adhesion protrusion to define a contraction space above the inclined adhesion protrusion, a plurality of valves protruding from a bottom surface of the porous valve plate, the plurality of valves being selectively opened or closed according to the contraction and expansion of the porous valve plate in a state where the valves are inserted into holes defined in the inner cushion to discharge contaminated air within the shoe into the air chamber of the sole, and an intermediate sole and insole which are successively stacked on a top surface of the porous valve plate. The intermediate sole and the porous valve plate may be frequently contracted or expanded through the contraction and restoring space by a load transferred during the walking when compared to shoes according to a related art. Thus, air within the shoes may be physically discharged.

1 Claim, 4 Drawing Sheets

(56) References Cited

U.S. PATENT DOCUMENTS

| | | | | |
|---|---|---|---|---|
| 6,041,519 | A | 3/2000 | Cheng | |
| 6,076,282 | A | 6/2000 | Brue' | |
| 6,751,890 | B1 | 6/2004 | Tsai | |
| 6,904,705 | B2 * | 6/2005 | Polegato Moretti | 36/11 |
| 7,316,081 | B1 * | 1/2008 | Cheng | 36/3 R |
| 7,712,229 | B2 * | 5/2010 | Yang | 36/3 B |
| 2005/0217140 | A1 * | 10/2005 | Melis | 36/3 B |
| 2005/0223594 | A1 * | 10/2005 | Issler | 36/3 B |
| 2005/0241180 | A1 * | 11/2005 | Squadroni | 36/3 B |
| 2008/0184600 | A1 * | 8/2008 | Yang | 36/3 B |
| 2009/0282704 | A1 | 11/2009 | Park | |

FOREIGN PATENT DOCUMENTS

| | | |
|---|---|---|
| JP | 2000-217604 | 8/2000 |
| KR | 10-2006-0016062 | 2/2006 |
| KR | 1020090025723 | 3/2009 |
| KR | 10-0906521 | 6/2009 |
| WO | 89/04125 | 5/1989 |

* cited by examiner

SHOES HAVING AN AIR CIRCULATION FUNCTION

Related Applications

This application is a 371 application of International Application No. PCT/KR2010/004656, filed Jul. 16, 2010, which in turn claims priority from Korean Patent Application No. 10-2010-0066681, filed Jul. 12, 2010, each of which is incorporated herein by reference in its entirety.

TECHNICAL FIELD

The present invention relates to a shoe having an air circulation function, and particularly, to a shoe having an air circulation function, which can enhance an air circulation function within a shoe by maximize a contraction width and a restoring width of an intermediate sole and a porous valve plate during walking.

BACKGROUND ART

As well known, a shoe is a means protecting a foot of a walking man, and a shoe is generally made with leather or synthetic resin having bad ventilation, and thus, an air circulation within a shoe is bad. Therefore, a bad smell occurs due to a sweat, moisture or the like in a shoe, and disease such as athlete's foot or eczema occurs due to bacteria propagation.

In order to solve such limitations, recently, a shoe having an air circulation apparatus is prevented. In a general configuration of the ventilation shoe, a pump is disposed inside a sole of a shoe, and an air emission pipe and an air suction pipe including a check valve connecting to the pump, are disposed in a front part of the shoe or a rear part of the shoe. Therefore, air within a shoe is sucked to the pump through the air suction pipe to be emitted to an outside of the shoe through the air emission pipe depending on a pumping operation of an elastic member disposed inside the pump, whenever a shoe is landed on a ground.

However, in the related art ventilation shoe, because the air suction pipe connects to a front part or a rear part of a shoe, air in a certain part of a shoe can be sucked or emitted. Therefore, air distributed over the whole shoe cannot be circulated efficiently.

There is a prior art solving the limitation. The prior art is applied by this applicant on Sep. 7, 2007, and registered on Jun. 30, 2009 (Korean Patent Registration No. 10-0906521 titled as "a footwear having a function of air circulation").

The prior art having an air circulating apparatus includes a sole, a porous valve plate, a plurality of valves and a hard elastic plate. The sole includes a plurality of air chambers connecting to each other through a vent passage, and a passage formed in a circumference, connecting to the air chamber and discharging air to the outside. The porous valve plate is covered on a top surface of the sole. Each of the plurality of valves protrudes from a bottom surface of the porous valve plate, is inserted to the air chamber, is selectively opened or closed depending on an air pressure, and discharge the polluted air within the shoe to the air chamber. Also, the hard elastic plate is disposed between the porous valve plate and the sole, and disperses the load applied to the heel to the whole sole, and thus, uniformly contracts the air chambers in the sole, during walking. Here, the valve has an elastic force, and is formed in a semicircular shape. A top surface of the valve is opened and an inside is vacant. A plurality of opening and closing part, which is spread to the outside depending on an expansion operation of a valve by an air pressure and discharges air flowing into the valve to the air chamber, are formed in the both circumference surfaces of the valve, and the opening and closing parts are incised.

However, in the prior art, as shown in FIG. 6, even though an intermediate sole and a porous valve plate are pushed with a weight of a user during walking, because a adhesion part protrusion 131 of peripheral part of the porous valve plate 130 of the sole 120 is horizontally formed, an intermediate sole 150 and the porous valve plate 130 are not pushed any more, and particularly, are not pushed above a contraction width and a restoring width of an inner cushion 135. Therefore, there are limitations in emitting air within a shoe to the outside.

BRIEF DESCRIPTION OF DRAWINGS

The accompanying drawings, which are included to provide a further understanding of the invention and are incorporated in and constitute a part of this application, illustrate embodiments of the invention and together with the description serve to explain the principle of the invention. In the drawings.

Figure 1:
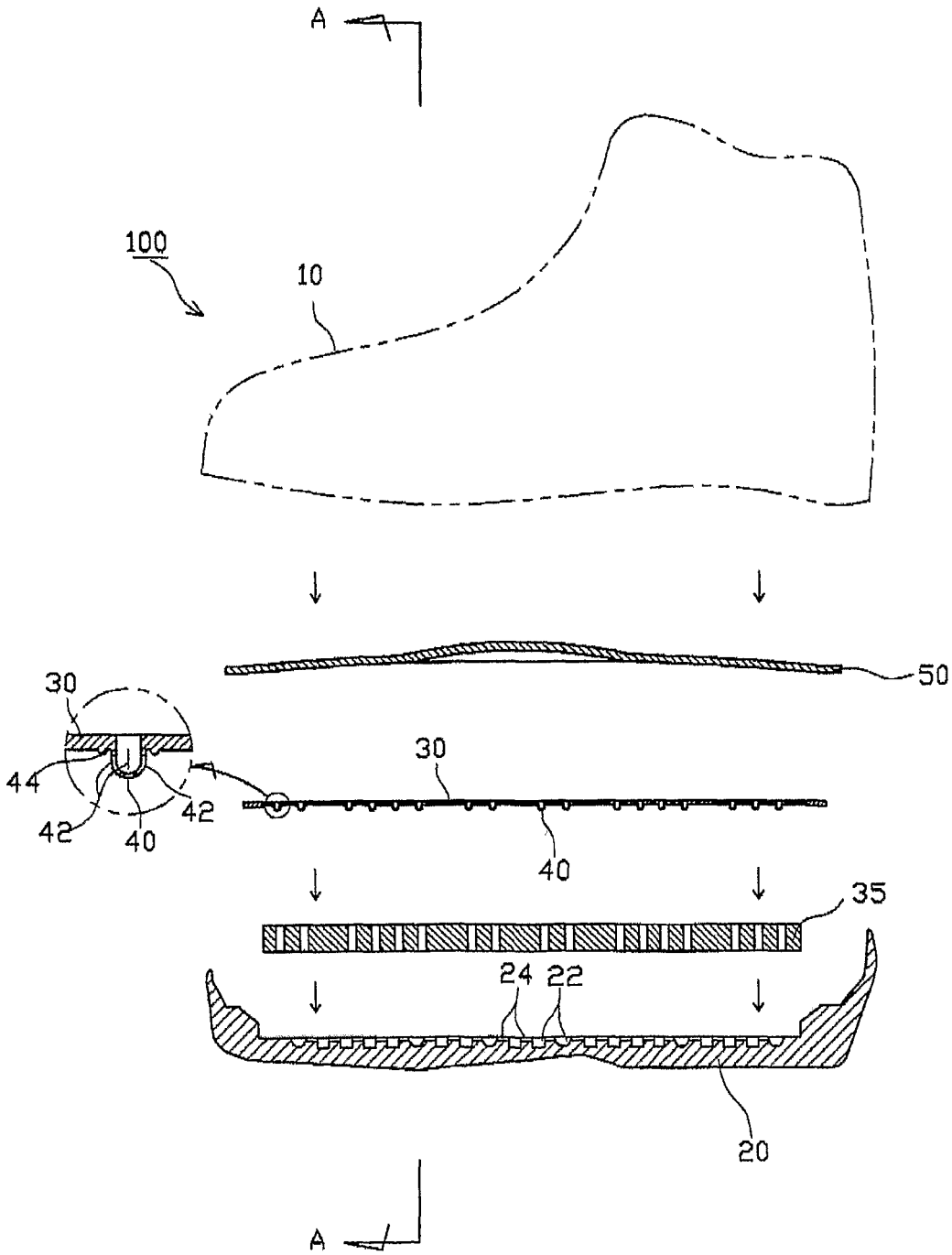
FIG. 1 is an exploded view illustrating a shoe having an air circulation function according to an embodiment of the present invention.

| Descriptions of reference numbers | |
|---|---|
| 10: upper leather | 20: sole |
| 21: receiving groove | 22: air chamber |
| 24: vent passage | 26: passage |
| 30: porous valve plate | 40: valve |
| 42: opening and closing part | 44: protrusion part |
| 60: inclined adhesion protrusion | 70: contraction space |

DISCLOSURE OF INVENTION

Accordingly, the present invention is directed to provide a shoe having an air circulation function which substantially obviates one or more problems due to limitations and disadvantages of the related art. An aspect of the present invention is directed to provide a shoe having an air circulation function which maximizes a contraction width and a restoring width of an inner cushion of an intermediate sole and a porous valve plate to enhance a air circulation function within the shoe, during walking.

To achieve these and other advantage and in accordance with the purpose of the invention, as embodied and broadly described herein, there is provided a shoe having an air circulation function which includes: a sole comprising a receiving groove formed in a central portion of a top surface of the sole, an air chamber emitting air to a bottom of the receiving groove, a vent passage and a passage; an inner cushion disposed on the receiving groove of the sole to provide a cushioning force for restoring an intermediate and a porous valve plate during walking; an inclined adhesion protrusion disposed along an periphery of the receiving groove of the sole and sloping down from an outside to an inside of the sole; a porous valve plate stacked on a top surface of the inner cushion, having a lower end peripheral surface contacting a top surface of the inclined adhesion protrusion with face to face contact, and forming a contracting and restoring space above the top surface of the inclined adhesion protrusion 60 for sucking air within the shoe; a plurality of valves protruding from a bottom surface of the porous valve plate, and selectively opened or closed depending on the contraction and expansion of the porous valve plate pressed by the intermediate sole, when each of the valves is being inserted into the hole formed in the inner cushion, to discharge contaminated air within the shoe into the air chamber of the sole; and an intermediate sole and insole successively stacked on a top surface of the porous valve plate, wherein, the intermediate sole and the porous valve plate are greatly contracted and restored through the contraction and restoring space by a load transferred during walking, and thus, air within the shoes is discharged.

Modes For Carrying Out The Invention

Hereinafter, an embodiment of the present invention will be described in detail with reference to the accompanying drawings. In the description described below, a typical embodiment to solve the purpose of the present invention will be described. Also, the other embodiments will be described in the below-described embodiment.

The present invention provides a shoe having an air circulation function. In the shoe according to the present invention, an inclined adhesion protrusion is formed along a receiving groove of a porous valve plate formed in a surface of a sole, a lower end peripheral surface of the porous valve plate closely contacts the inclined adhesion protrusion. To increase a contraction and restoring space a thickness of an inner cushion is formed to be greater than a depth of the receiving groove of the sole. Also, to increase contraction and restoring force of the porous valve plate, a central portion of an intermediate sole protrudes to a top surface. Therefore, if an upper leather, an intermediate sole and a sole are combined, the porous valve plate is expanded to the protruded portion of a top surface of a central portion of the porous valve and the intermediate sole with a restoring force of the inner cushion. Therefore, when the intermediate sole and the porous valve plate are pushed by a load of a walker during walking, a contraction and restoring width increases through the contraction and restoring space, and thus, much more air within a shoe can be efficiently circulated.

Hereinafter, embodiments of the present invention will be described in detail with reference to the accompanying drawings.

Figure 2:
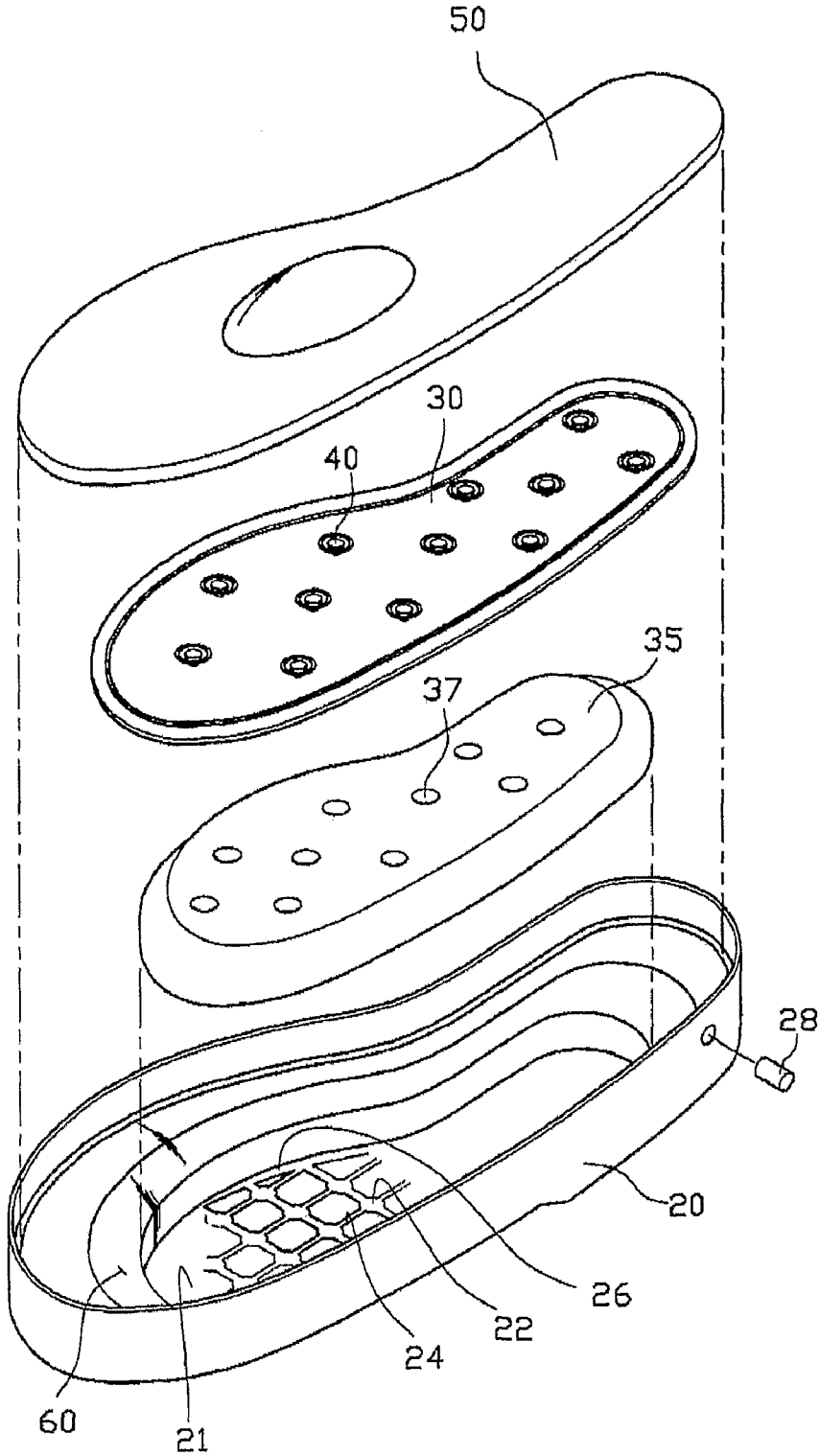
FIG. 2 is an exemplary diagram three-dimensionally illustrating a configuration of a porous valve plate and a sole shown in FIG. 1.

FIG. 1 is an exploded view illustrating a shoe having an air circulation function according to an embodiment of the present invention. FIG. 2 is an exemplary diagram three-dimensionally illustrating a configuration of a porous valve plate and a sole shown in FIG. 1.

As shown in FIGS. 1 and 2, the shoe 100 having an air circulation function includes an upper leather 10, a sole 20 forming a bottom of the upper leather 10, and an inner cushion 35, a porous valve plate 30 and an intermediate sole 50 which are successively stacked on the sole 20.

The inner cushion 35 is inserted to a receiving groove 21 formed in a central portion of a top surface of the sole 20, and used for providing a primary cushion force to increase an air circulation amount during walking. A hole 37 through which a valve 40 protruding from a bottom surface of the porous valve plate 30 penetrates is formed in the inner cushion 35.

The porous valve plate 30 is formed of a rubber material, formed in a planar shape, and is stacked on the inner cushion 35 inserted to the receiving groove formed in a top surface of the sole 20 to be adhered to an inclined adhesion protrusion 60.

A plurality of valves 40 are integrally formed to protrude in the whole bottom surface of the porous valve plate 30. Each of the valves 40 has certain elastic force, is respectively inserted to a hole 37 formed in the inner cushion 35, is opened or closed depending on an air pressure occurring during walking, and emits a contaminated air to an air chamber 22 connecting to the hole 37 in the inner cushion 35.

Figure 3:
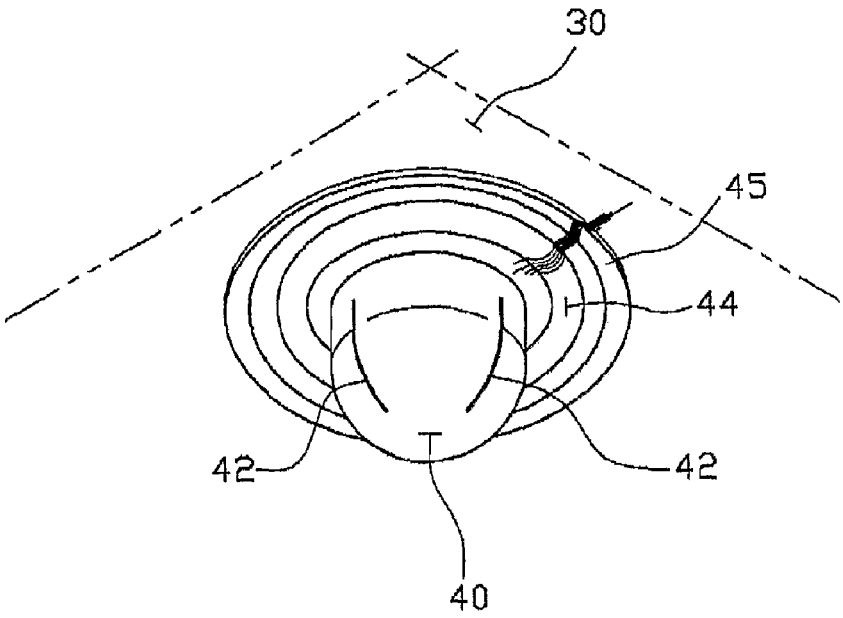
FIG. 3 is an exemplary diagram illustrating a configuration of a valve formed in the porous valve plate shown in FIG. 2 in detail.

FIG. 3 is an exemplary diagram three-dimensionally illustrating a configuration of a valve 40 among a plurality of valves formed in the porous valve plate 30.

As shown in FIG. 3, the valve 40 has certain elastic force, a top surface of the valve 40 is opened, an inside of the valve 40 is vacant, and the valve 40 is formed in a semi-elliptical shape. Also, a plurality of opening and closing parts 42, which are incised, are formed in the both circumferences surface of the valve 40. In the valve 40 configured as described above, the opening and closing part 42 is closed with an air pressure occurring during walking, and then, the check valve 28 is opened, and thus, air is emitted. Also, again, the porous valve plate 30 is restored with elasticity of the inner cushion 35, and thus, the opening and closing part 42 of the valve 40 repeatedly sucks and emits air. That is, if contaminated air within a shoe flows into inside the valve 40, the valve 40 elastically emits the contaminated air flowing into the valve 40. At this point, the opening and closing parts 42 formed in both circumference surfaces of the valve 40 are spread, and thus, air flowing into the valve 40 is sucked to the air chamber 22 of the sole 20. Then, the contaminated air sucked to the air chamber 22 is emitted to the outside through a vent passage 24, a passage 26 and the check valve 28. Therefore, contaminated air within a shoe can be emitted to the outside.

A protrusion part 44 is integrally formed in a periphery of the valve 40. The protrusion part 44 prevents a transformation from being transferred to the valve 40. Here, the transformation occurs when the porous valve plate 30 formed of a rubber material is softened to be transformed due to a chemical action in an adhesive in a process of adhering the porous valve plate 30 to a inclined adhesion protrusion 60 of a top surface of the sole 20 with a adhesive. That is, the valve 40 is injection-molded with the porous valve plate 30 when the porous valve plate 30 is molded. Therefore, if the porous valve plate 30 is softened to be transformed, the valve 40 is also softened to be transformed with the porous valve plate 30. At this point, the protrusion part 44 prevents the transformation from being transferred to the valve 40, and thus, a transformation in the valve 40 can be prevented.

Moreover, a contraction preventing groove 45 is formed in a periphery of the protrusion part 44 in a shape where the contraction preventing groove 45 is recessed, and the contraction preventing groove 45 prevents the transformation, which occurs due to a chemical action in a process of adhering the porous valve plate 30 to a inclined adhesion protrusion, from being transferred to the valve 40, together with the protrusion part 44.

Here, the sole 20 configures a bottom of the shoe, the receiving groove 21, into which the inner cushion 35 is inserted, is formed to be recessed in a central portion of a top surface of the sole 20, and a plurality of an air chambers 22 are formed to be recessed in a surface of the receiving groove 21 at certain intervals. Each of the valves 40 formed in the porous valve plate 30 is inserted into the air chamber 22, and thus, each of the air chambers 22 is supplied with contaminated air within a shoe depending on an opening and closing operation of the valve 40.

The vent passages 24 are formed between the air chambers 22, and the vent passage 24 connects the air chambers 22 to each other.

Moreover, the passage 26 is formed in a periphery of a top surface of the sole 20, and the passage 26 connects to some vent passages 24 formed in a periphery of the sole 20.

As described above, the air chamber 22, the vent passage 24 and the passage 26 connect to each other and open into each other. Therefore, contaminated air flowing into the air chamber 22 depending on an operation of the valve 40 is emitted to the outside through the vent passage 24 and the passage 26 and finally through the check valve 28 formed in one side of the passage 26.

Figure 4:
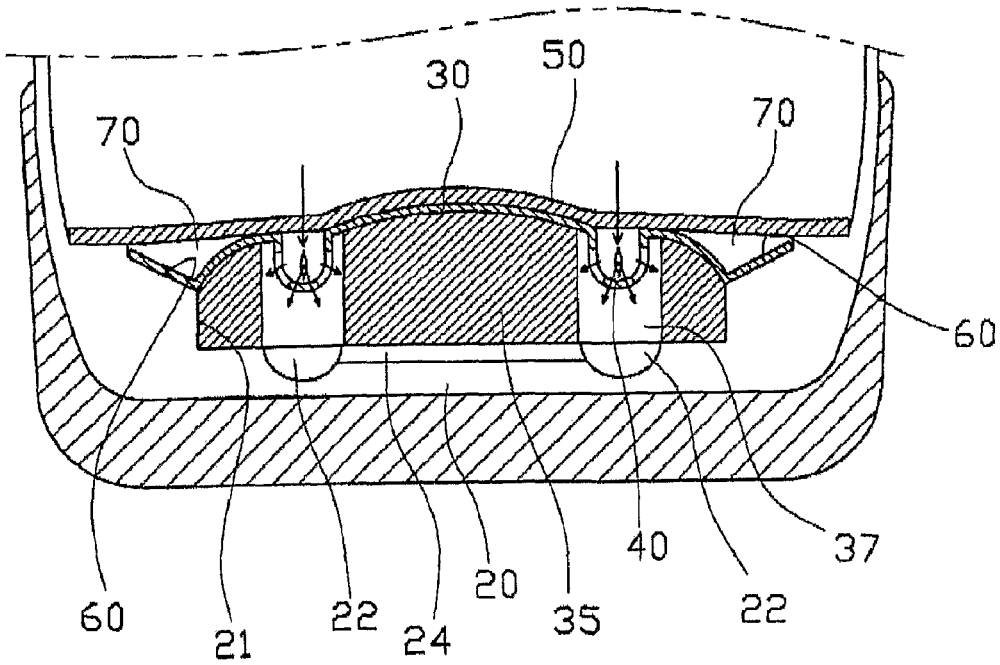
FIG. 4 is a sectional view taken along line A-A' shown in FIG. 1.

Here, FIG. 4 is a sectional view taken along line A-A' shown in FIG. 1 and illustrating a stacking state of the sole 20, the inner cushion 35, the porous valve plate 30 and the intermediate sole 50.

As shown in FIG. 4, the inner cushion 35 inserted into the receiving groove 21 of the sole 20 is manufactured thickly such that the top surface of the inner cushion 35 is located at a position higher than that of the horizontal surface horizontal to the top surface of the sole 20 when the top surface of the inner cushion 35 is protruding to the outside of the of the receiving groove 21.

An inclined adhesion protrusion 60 is formed in the sole 20 along a peripheral surface of the receiving groove 21 of the sole 20. The inclined adhesion protrusion 60 is formed to slope down from an outside to an inside of the sole 20 at a certain angle. A lower end peripheral surface of the porous valve plate 30 contacts a top surface of the inclined adhesion protrusion 60 with face to face contact, and thus, a contraction space 70 is formed between the porous valve plate 30 and the inclined adhesion protrusion 60. Then, the intermediate sole 50 is successively stacked on the porous valve plate 30.

Figure 5:
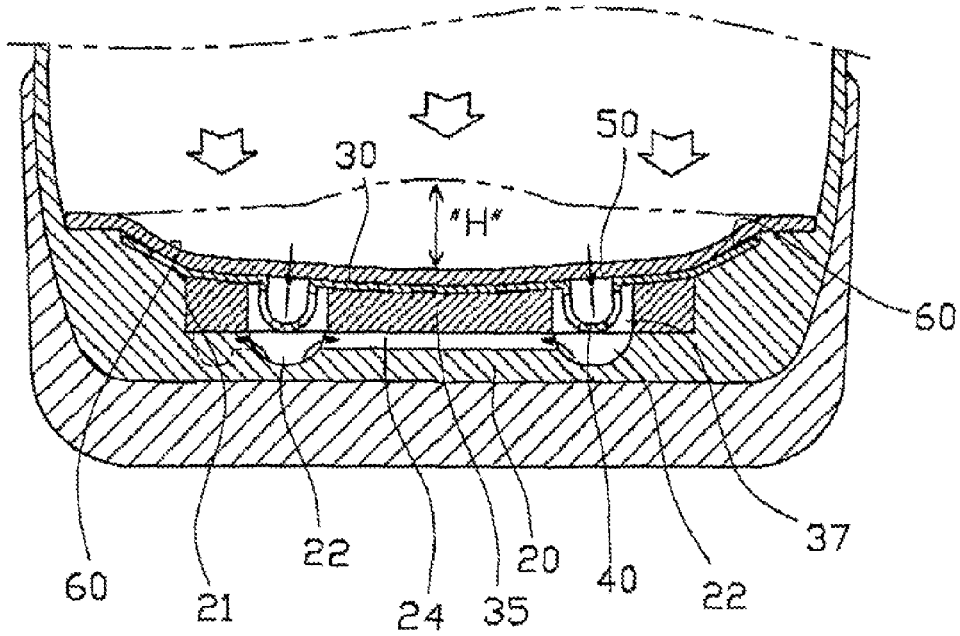
FIG. 5 is an exemplary diagram illustrating a state in which a foot of a walker shown in FIG. 4 is being landed on a ground.

According to the above-described stacking configuration, as shown in FIG. 5, when the intermediate sole 50 and the porous valve plate 30 are pushed by a load of a walker, the intermediate sole 50 and the porous valve plate 30 can be more pushed by the slope angle in the contraction space 70 formed between the porous valve plate 30 and the inclined adhesion protrusion 60. Therefore, a greater contraction and restoring width (H) can be formed by an up-and-down movement of the intermediate sole 50 and the porous valve plate 30, and thus, much more air within a shoe can be emitted to the outside of the shoe when compared with a related art shoe.

Figure 6:
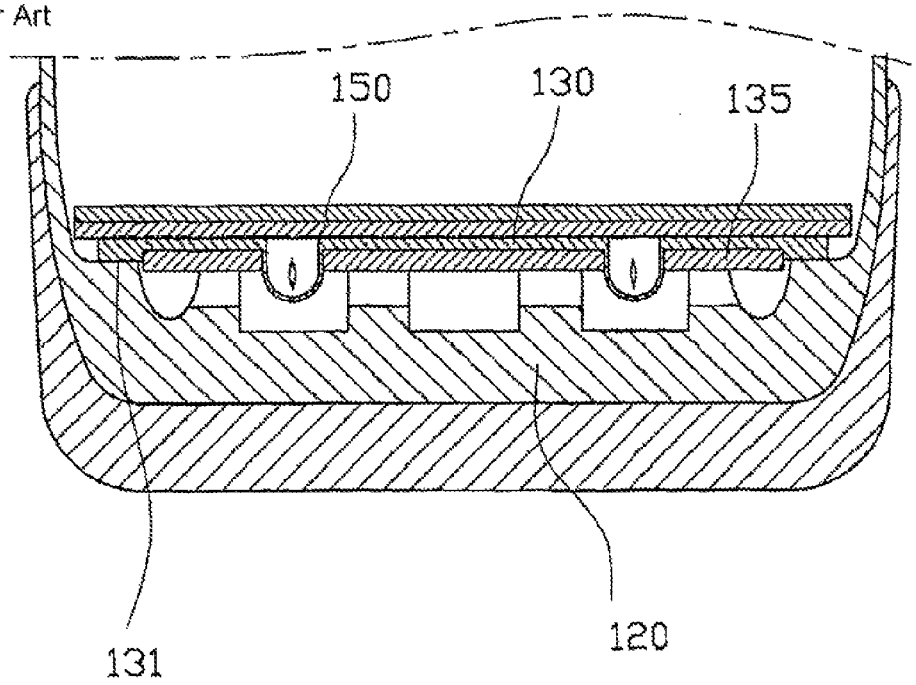
Fig. 6 Prior Art
FIG. 6 is an exemplary diagram illustrating a configuration of a related art general shoe having an air circulation function.

That is, the air permeability of shoe remarkably differs depending on the contraction width (H) of the intermediate sole 50 and the porous valve plate 30 during walking, and the reason is because much more air within a shoe can be emitted through the valve 40 formed in the porous valve plate 30 as the contraction width (H) of the intermediate sole 50 and the porous valve plate 30 becomes greater. Therefore, in the present invention, because the slope angle of the contraction and restoring space 70 formed with the inclined adhesion protrusion 60 and the thickness of the inner cushion 35 are greater than that of the related art shoe shown in FIG. 6, the greater contraction width (H) of the intermediate sole 50 and the porous valve plate 30 can be naturally formed, and thus, the air permeability of a shoe can be enhanced.

Hereinafter, an operation of the shoe having an air circulation function according to the present invention will be described with reference to FIGS. 1 to 5.

First, as shown in FIG. 4, if a foot in the shoe 100 takes off a ground, the inner cushion 35 is restored, and thus, the contaminated air within the shoe is sucked into the receiving groove 21 through the intermediate sole 50 when the opening and closing part 42 formed in a side surface of the valve 40, which is an air emission means, formed in the porous valve plate 30 is being opened.

Next, if the foot lands on a ground, as shown in FIG. 5, the opening and closing part 42 of the valve 40 is closed by a load of a walker and an air pressure, and thus, the air chamber 22 of the receiving groove 21 of the sole 20 contracts. In this case, the air flowing into the chamber 22 is emitted to the outside through the vent passage 24 and the passage 26, and finally through the check valve 28 connecting to the passage 26. At this point, because the valves 40 is formed with a load of a walker and a contraction of the air chamber 22, any interference and contact does not occur between the valves 40, and thus, malfunction due to a damage of the opening and closing part 42 of the valve 40 can be prevented.

At this point, as shown in FIG. 5, when the intermediate sole 50 and the porous valve plate 30 are pushed with a load of a walker, the intermediate sole 50 and the porous valve plate 30 are much more pushed through the contraction space 70 formed between the porous valve plate 30 and the inclined adhesion protrusion 60 by the slope angle of the contraction space than the related art. Therefore, the greater contraction width (H) of the intermediate sole 50 and the porous valve plate 30 can be naturally formed, and the air permeability of a shoe can be enhanced, and thus, much more air within the shoe can be emitted through the valve 40 formed in the porous valve plate 30.

Industrial Applicability

In the shoe having an air circulation function according to the present invention, the inclined adhesion protrusion is formed along the periphery of the receiving groove, a lower end peripheral surface of the porous valve plate contacts the inclined adhesion protrusion with face to face contact, and thus, the contraction and restoring space is formed with the restoring force of the porous valve plate and the inner cushion. Therefore, when the intermediate sole and the porous valve plate are pushed with a load of a walker during walking, the contraction and restoring width (H) of the intermediate sole and the porous valve plate increases through the contraction and restoring space 70 of the inner cushion. Therefore, air within the shoe can be efficiently circulated.

The invention claimed is:

1. A shoe having an air circulation function, the shoe comprising:

a sole 20 comprising a receiving groove 21 formed in a central portion of a top surface of the sole, an air chamber 22 emitting air to a bottom of the receiving groove 21, a vent passage 24 and a passage 26;

an inner cushion 35 disposed on the receiving groove 21 of the sole 20 to provide a cushioning force for restoring an intermediate sole and a porous valve plate during walking;

an inclined adhesion protrusion 60 disposed along an periphery of the receiving groove 21 of the sole 20 and sloping down from an outside to an inside of the sole 20;

a porous valve plate 30 stacked on a top surface of the inner cushion 35, having a lower end peripheral surface contacting a top surface of the inclined adhesion protrusion 60 with face to face contact, sucking contaminated air to an upper side of the inclined adhesion protrusion 60, and expanding an intermediate sole 50 with contraction and restoration;

a plurality of valves 40 protruding from a bottom surface of the porous valve plate 30, and selectively opened or closed depending on the contraction and expansion of the porous valve plate 30, when each of the valves is being inserted into the hole 37 formed in the inner cushion 35, to discharge contaminated air within the shoe into the air chamber 22 of the sole; and an intermediate sole 50 and insole 51 successively stacked on a top surface of the porous valve plate 30, wherein, the intermediate sole 50 and the porous valve plate 30 are greatly contracted through the contraction and restoring space 70 by a load transferred during walking, and thus, air within the shoes is discharged.

* * * * *